US008408874B2

(12) United States Patent
McCaffrey et al.

(10) Patent No.: US 8,408,874 B2
(45) Date of Patent: Apr. 2, 2013

(54) PLATFORMLESS TURBINE BLADE

(75) Inventors: Michael G. McCaffrey, Windsor, CT (US); Eric A. Hudson, Harwinton, CT (US)

(73) Assignee: United Technologies Corporation, Hartford, CT (US)

( * ) Notice: Subject to any disclaimer, the term of this patent is extended or adjusted under 35 U.S.C. 154(b) by 969 days.

(21) Appl. No.: 12/101,326

(22) Filed: Apr. 11, 2008

(65) Prior Publication Data

US 2009/0257875 A1 Oct. 15, 2009

(51) Int. Cl.
*F01D 5/32* (2006.01)

(52) U.S. Cl. ..... 416/193 A; 416/220 R; 416/248

(58) Field of Classification Search ..... 416/96 R, 416/97 R, 193 A, 196 R, 220 R, 222, 248; 415/174.5, 199.5
See application file for complete search history.

(56) References Cited

U.S. PATENT DOCUMENTS

| | | | | |
|---|---|---|---|---|
| 3,694,104 | A * | 9/1972 | Erwin | 416/217 |
| 4,501,053 | A * | 2/1985 | Craig et al. | 29/889.721 |
| 5,030,063 | A * | 7/1991 | Berger | 416/220 R |
| 5,240,377 | A * | 8/1993 | Farr | 416/229 R |
| 5,310,317 | A * | 5/1994 | Bailey et al. | 416/215 |
| 6,190,131 | B1 * | 2/2001 | Deallenbach | 416/144 |
| 6,478,539 | B1 * | 11/2002 | Trutschel | 415/223 |
| 6,951,447 | B2 | 10/2005 | Cherolis et al. | |
| 7,007,382 | B2 | 3/2006 | Mantel | |
| 7,094,021 | B2 | 8/2006 | Haubert | |
| 7,255,536 | B2 | 8/2007 | Cunha et al. | |
| 7,261,518 | B2 | 8/2007 | Golinkin et al. | |
| 7,874,804 | B1 * | 1/2011 | Brown | 416/193 A |
| 2007/0020102 | A1 | 1/2007 | Beeck et al. | |
| 2007/0041838 | A1 | 2/2007 | Charbonneau et al. | |
| 2007/0148000 | A1 | 6/2007 | Marusko et al. | |
| 2007/0189901 | A1 * | 8/2007 | Dundas et al. | 416/223 A |
| 2007/0196693 | A1 | 8/2007 | Steibel et al. | |

OTHER PUBLICATIONS

U.S. Appl. No. 11/220,291, "Platform Mate Face Contours for Turbine Airfoils", filed Sep. 6, 2005.

* cited by examiner

*Primary Examiner* — Ninh H Nguyen
(74) *Attorney, Agent, or Firm* — Carlson, Gaskey & Olds, P.C.

(57) ABSTRACT

A turbine blade rotor assembly is disclosed for a gas turbine engine. The assembly includes a rotor having nickel alloy turbine blades secured thereto. Each of the blades includes a root and an airfoil. The roots are supported by the rotor. A ceramic matrix composite platform separate from the turbine blades is supported between each pair of the turbine blades adjacent to the airfoils. In another example, the airfoil includes a perimeter. A shroud having an aperture receives the airfoil with a single shroud substantially surrounding the airfoil at the perimeter. In one example, the turbine blade includes high and low pressure sides opposite one another that extend from a tip to a root. The airfoil is free from any protrusions extending from the high and low pressure sides on a portion of the blade axially outward from the root.

7 Claims, 3 Drawing Sheets

PLATFORMLESS TURBINE BLADE

BACKGROUND

This disclosure relates to a turbine blade rotor assembly. In particular, the disclosure relates to an assembly for which a platform adjacent to the turbine blade is provided by a separate structure.

Typical turbine blades for a gas turbine engine are constructed from a nickel alloy. Multiple turbine blades are arranged circumferentially about a rotor and secured thereto by their roots. Typically, turbine blades include integral platforms extending circumferentially from both the high and low pressure sides of the airfoil near the root. The platforms act as flow guides that divert airflow along a desired flow path.

It is desirable to increase turbine rotor speed to improve the performance and efficiency of gas turbine engines. The turbine rotor speed is limited by the loads on the turbine blades. In particular, the turbine blades, which are typically constructed from nickel alloy, speed can be limited by the attached platforms, which curl and crack under loads.

In an effort to reduce turbine blade cooling flows, it has been suggested that turbine blades could be constructed from a ceramic matrix composite (CMC). This design approach endeavored to eliminate the use of nickel in the turbine blade and substitute a high temperature CMC. The layered construction of the CMC blade favors a direct connection between the attachment feature and the airfoil itself. To simplify the construction, the platforms are provided by separate structure that is secured to the rotor because providing an integral platform to a CMC blade is very difficult.

The current state of the art cooling schemes for nickel alloy blade have improved the thermal capability such that alternative material such as CMC may not offer significant benefits. However, the problem of blade platform capability remains. Thus, it is desirable to utilize a nickel alloy blade that does not have platforms that crack at increased turbine rotor speeds.

SUMMARY

A turbine blade rotor assembly is disclosed for a gas turbine engine. The assembly includes a rotor having nickel alloy turbine blades secured thereto. Each of the blades includes a root and an airfoil. The roots are supported by the rotor. A ceramic matrix composite platform separate from the turbine blades is supported between each pair of the turbine blades adjacent to the airfoils. In one example, the airfoil includes a perimeter. A shroud having an aperture receives the airfoil with a single shroud substantially surrounding the airfoil at the perimeter. In one example, the turbine blade includes high and low pressure sides opposite one another that extend from a tip to a root. The airfoil is free from any protrusions extending from the high and low pressure sides on a portion of the blade axially outward from the root.

These and other features of the disclosure can be best understood from the following specification and drawings, the following of which is a brief description.

DETAILED DESCRIPTION

Figure 1:
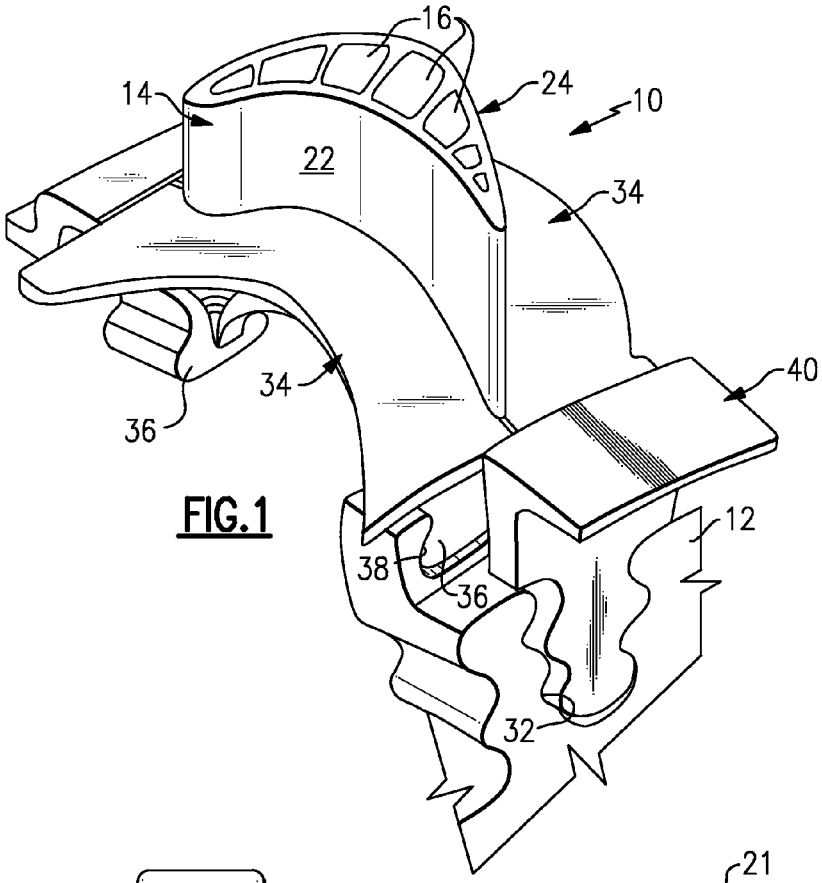
FIG. 1 is a perspective view of an example turbine blade rotor assembly.

An example turbine blade rotor assembly 10 is shown in FIG. 1. The assembly 10 includes a rotor 12 that supports a blade 14 by its root 18. The blade 14 extends from the root 18 to a tip 21 (FIG. 2) to provide an airfoil 20. The blade 14 may also include cooling passages 16. In one example, the blade 14 is constructed from a nickel alloy.

The airfoil 20 includes pressure and suction sides 22, 24 that extend between leading and trailing edges 26, 28. The airfoil 20 includes a perimeter 30 about which one or more platforms 34 are arranged to direct airflow in a desired path. The platforms 34 are constructed from a ceramic material, such as a ceramic matrix composite (CMC) or a monolithic ceramic. The platforms 34 include a base 36 that is secured to the rotor 12. In the example shown in FIG. 1, the rotor 12 includes an aperture 38 having a complimentary shape to that of the base 36. The platforms 34 shown in FIG. 1 are arranged adjacent to the pressure and suction sides 22, 24, extending approximately to the leading and trailing edges 26, 28. Flow guides 40 are arranged on either side of the airfoil 20 at the leading and trailing edges 26, 28. The flow guides 40 can also be constructed from a CMC.

Figure 3:
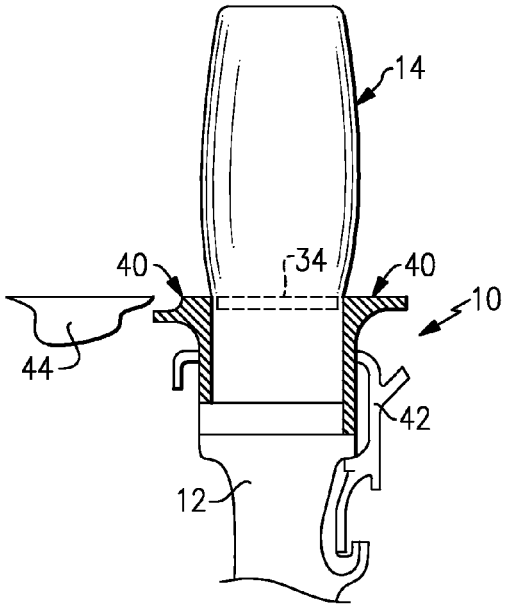
FIG. 3 is a side elevational view of the assembly shown in FIG. 1.
Figure 2:
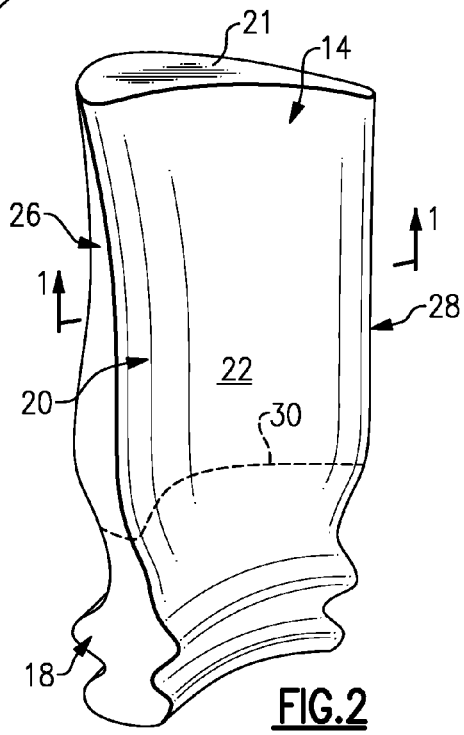
FIG. 2 is a perspective view of a turbine blade shown in FIG. 1.

In the example shown in FIG. 2, the blade 14 includes a root 18 having a fir-tree shape that is received in a complimentary slot 32 (FIG. 1). The flow guides 40 include structure that is also received in the slot 32. Referring to FIGS. 2 and 3, the flow guides 40 are secured about the platforms 34 and blades 14 to the rotor 12 by a retainer 42. The flow guides 40 are arranged axially adjacent to structure 44.

Figure 4B:
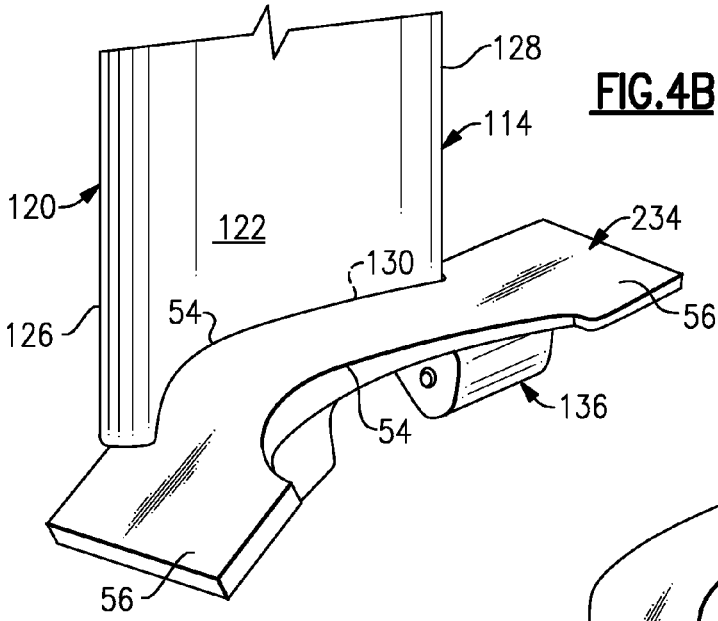
FIG. 4B is a perspective view of another example platform.
Figure 4A:
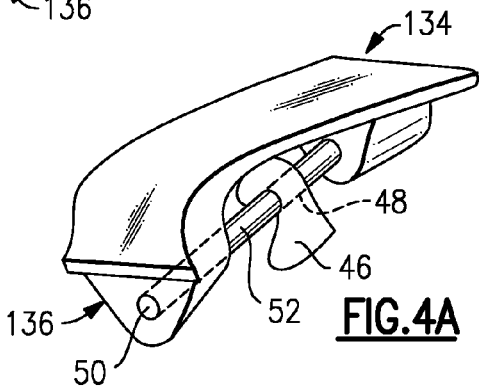
FIG. 4A is a perspective view of one example platform.

Referring to FIG. 4A, a platform 134 includes a base 136 having apertures 50 that align with a hole 48 in the rotor structure 46, which is illustrated in a highly schematic fashion. A pin 52 is received by the hole 48 and the apertures 50 to secure the platform 134 to the rotor structure 46. In another example shown in FIG. 4B, a platform 234 includes flow guides 56 integrated to the platform 234. The platform 234 includes opposing sides 54 that are adjacent to the airfoil 120 about perimeter 130. The integrated flow guides 56 extend beyond the leading and trailing edges 126, 128. One of the sides 54 is arranged adjacent to the high pressure side 122, and the other side 54 is arranged adjacent to the low pressure side of another blade 114 (not shown).

Figure 5A:
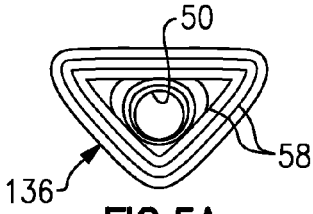
FIGS. 5A-5D are cross-sectional views of example platform and base configurations.
Figure 5B:
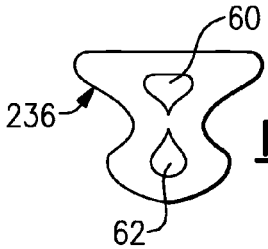
Figure 5D:
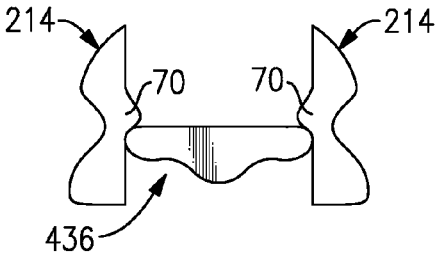
Figure 5C:
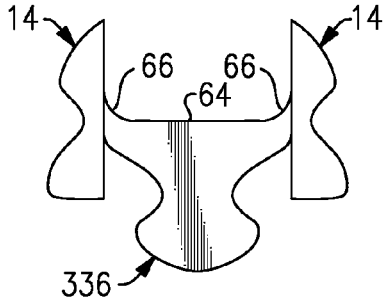

A cross-section of various platforms are shown in FIGS. 5A-5D. In the example shown in FIG. 5A, the base 136 includes fibers 58 that are oriented to wrap about the aperture 50 to increase the strength of the base 136. In another example shown in FIG. 5B, a platform 236 includes a cavity 60 filled with a material 62 that is different than the ceramic matrix composite material of the platform 236. The material 62 further lightens the platform 236 to reduce the stress on the platform 236. Referring to FIG. 5C, a platform 336 includes fillets 66 extending from an outer surface 64. The fillets 66 are provided on the opposing sides 154 adjacent to the surface of the blade 14. Referring to FIG. 5D, the blades 214 include protrusions 70 extending from the airfoil to support a platform 436. The protrusions 70 supported the platform 436 in a radial direction.

Figure 7:
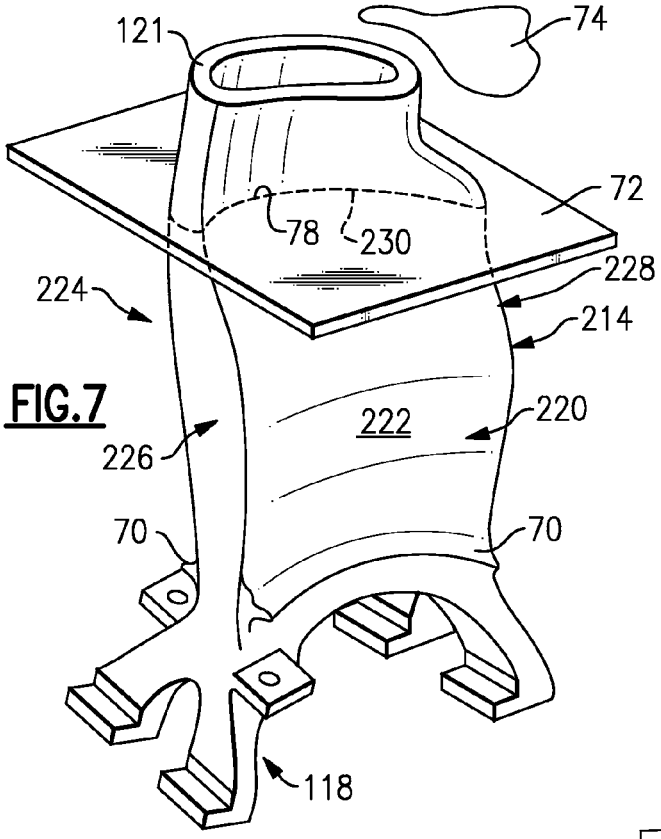
FIG. 7 is a perspective view of an example turbine vane with a ceramic matrix composite shroud.
Figure 6:
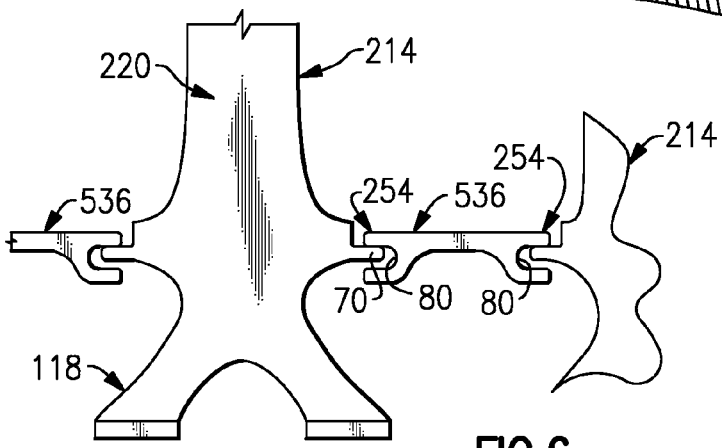
FIG. 6 is a cross-sectional view of a pair of turbine vane and platforms arranged between the turbine blades.

Another example arrangement between the protrusions 70 and platform 536 is shown in FIGS. 6 and 7. In the example, the platforms 536 are secured not by the rotor, but instead by the base of adjacent turbine vanes 214. The platform 536 includes opposing sides 254 having longitudinal recesses 80 that receive the protrusions 70. The vane 214 includes a root 118 having a footed configuration.

Figure 8:
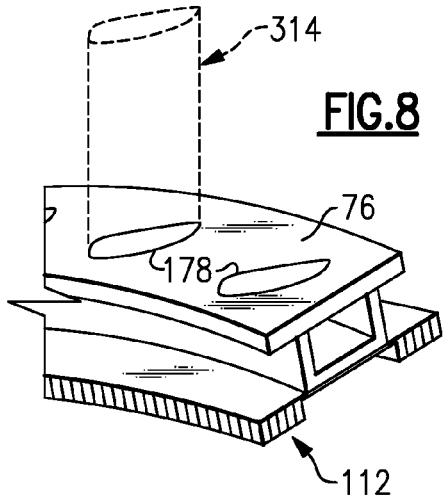
FIG. 8 is a perspective view of a shroud supported by a platform through which the turbine vane extend.

Referring to FIG. 7, a vane 214 includes an airfoil 220 that extends to a tip 121 adjacent to a vane outer air shroud 74. A perimeter 230 of the airfoil 220 is received by an opening 78 of an inner flowpath surface 72. The inner flowpath surface 72 is constructed from a ceramic matrix composite material. The inner flowpath surface 72 extends substantially around the perimeter 230. That is, the inner flowpath surface 72 substantially surrounds the pressure and suction sides 222, 224 and the leading and trailing edges 226, 228. In another example shown in FIG. 8, the inner flowpath surface serves as a platform 76 that supports an inner seal assembly 112. The blade 314 extends through the opening 178.

Although example embodiments have been disclosed, a worker of ordinary skill in this art would recognize that certain modifications would come within the scope of the claims. For that reason, the following claims should be studied to determine their true scope and content.

What is claimed is:

1. A turbine blade rotor assembly for a gas turbine engine comprising:

a rotor;

nickel alloy turbine blades each having a root and an airfoil, the roots supported by the rotor; and a ceramic platform supported between each pair of the turbine blades adjacent to the airfoils, wherein the turbine blades include leading and trailing edges opposite one another, and comprising leading and trailing flow guides supported by the rotor and arranged axially from the leading and trailing edges respectively, the flow guides are discrete from the platforms.

2. The assembly according to claim 1, comprising at least one retainer secured relative to the rotor adjacent to the flow guides for maintaining a desired position of the flow guides.

3. The assembly according to claim 1, wherein the flow guides include a ceramic material.

4. A turbine blade rotor assembly for a gas turbine engine comprising:

a rotor;

nickel alloy turbine blades each having a root and an airfoil, the roots supported by the rotor; and a ceramic platform supported between each pair of the turbine blades adjacent to the airfoils, wherein the platforms include a base having an aperture, and the rotor includes a hole, a pin received in the hole and the aperture securing each platform to the rotor.

5. The assembly according to claim 4, wherein the ceramic is a ceramic matrix composite including fibers, the fibers in the base wrapped around the aperture in a desired orientation.

6. A turbine vane assembly for a gas turbine engine comprising:

a turbine vane including an airfoil extending from a root, the airfoil having a perimeter;

a platform near the root;

a shroud having an aperture receiving the airfoil, with a single shroud substantially surrounding the airfoil at the perimeter, the shroud constructed from a ceramic matrix composite material;

wherein the perimeter includes pressure and suction sides and leading and trailing edges, the single shroud extending from the leading and trailing edges along and adjacent to both the high and low pressure sides; and wherein the shroud is an inner flowpath surface spaced from the tip and the platform.

7. A turbine vane assembly for a gas turbine engine comprising:

a turbine vane including an airfoil extending from a root, the airfoil having a perimeter;

a platform near the root; and a shroud having an aperture receiving the airfoil, with a single shroud substantially surrounding the airfoil at the perimeter, the shroud constructed from a ceramic matrix composite material;

wherein the perimeter includes pressure and suction sides and leading and trailing edges, the single shroud extending from the leading and trailing edges along and adjacent to both the high and low pressure sides; and a case supporting the root, wherein the shroud is the platform, the platform secured to the vane and configured to be unsupported by a rotor, wherein the root includes legs axially spaced from one another, each leg including spaced apart feet supported on the case.

* * * * *